US008686302B2

(12) United States Patent
Brasher et al.

(10) Patent No.: US 8,686,302 B2
(45) Date of Patent: Apr. 1, 2014

(54) SELECTOR SWITCH ASSEMBLY FOR LOAD TAP CHANGER

(75) Inventors: Jon C. Brasher, Medina, TN (US); David M. Geibel, Jackson, TN (US); William J. Teising, Jackson, TN (US); Robert A. Elick, Jackson, TN (US); Bobby Owen Thurmond, Jr., Ripley, TN (US)

(73) Assignee: ABB Technology AG, Zurich (CH)

( * ) Notice: Subject to any disclaimer, the term of this patent is extended or adjusted under 35 U.S.C. 154(b) by 189 days.

(21) Appl. No.: 13/418,554

(22) Filed: Mar. 13, 2012

(65) Prior Publication Data

US 2012/0241300 A1 Sep. 27, 2012

Related U.S. Application Data

(60) Provisional application No. 61/467,455, filed on Mar. 25, 2011.

(51) Int. Cl.

| | |
|---|---|
| ***H01H 13/72*** | (2006.01) |
| ***H01H 9/26*** | (2006.01) |
| ***H01H 13/76*** | (2006.01) |

(52) U.S. Cl.

USPC ..... 200/5 B

(58) Field of Classification Search

USPC ... 200/5 B, 6 R, 7, 11 R, 11 TC, 17 R, 19.06, 200/19.07, 19.18–19.21, 51.05–51.07

See application file for complete search history.

(56) References Cited

U.S. PATENT DOCUMENTS

| | | | | |
|---|---|---|---|---|
| 3,764,891 | A * | 10/1973 | Lingenfelter et al. | 323/341 |
| 4,562,316 | A * | 12/1985 | Kranich, II | 200/16 D |
| 5,056,377 | A | 10/1991 | Yatchum et al. | |
| 5,191,179 | A * | 3/1993 | Yatchum et al. | 200/11 TC |
| 7,750,257 | B2 * | 7/2010 | Lindsey et al. | 200/11 TC |
| 2009/0211890 | A1 | 8/2009 | Xiao | |

FOREIGN PATENT DOCUMENTS

| | | | |
|---|---|---|---|
| DE | 19549238 | A1 | 6/1997 |

OTHER PUBLICATIONS

International Search Report & Written Opinion in PCT/Us20121028863 dated Jun. 21, 2012.

* cited by examiner

*Primary Examiner* — Edwin A. Leon
*Assistant Examiner* — Anthony R. Jimenez
(74) *Attorney, Agent, or Firm* — Manelli Selter PLLC; Edward J. Stemberger

(57) ABSTRACT

A selector switch assembly for a load tap changer includes a bevel gear coupled with a motor drive shaft. A shaft assembly is coupled with the bevel gear and a switch is provided for each phase. Each switch includes a helical gear fixed to the shaft assembly, a Geneva pinion gear engaged with the helical gear, a first Geneva gear wheel mounted on a first shaft moved by a first follower of the pinion gear, a first contact arm associated with the first Geneva gear wheel to rotate therewith, a second Geneva gear wheel mounted on a second shaft and moved by a second follower of the pinion gear, and a second contact arm associated with the second Geneva gear wheel so as to rotate therewith. The contact arms include contacts that engage fixed contacts that define tap positions of the load tap changer.

21 Claims, 7 Drawing Sheets

SELECTOR SWITCH ASSEMBLY FOR LOAD TAP CHANGER

BACKGROUND OF THE INVENTION

The present invention relates to load tap changers and, more particularly, to selector switch assembly for a load tap changer.

As is well known, a transformer converts electricity at one voltage to electricity at another voltage, either of higher or lower value. A transformer achieves this voltage conversion using a primary winding and a secondary winding, each of which are wound on a ferromagnetic core and comprises a number of turns of an electrical conductor. The primary winding is connected to a source of voltage and the secondary winding is connected to a load. Voltage present on the primary winding is induced on the secondary winding by a magnetic flux passing through the core. The voltages induced on each turn of the secondary winding are cumulative and therefore the voltage output from the secondary winding is proportional to the strength of the magnetic flux and the number of turns in the secondary winding. Since the amount of magnetic flux generated by the primary winding is proportional to the number of turns in the primary winding and the voltage produced by the secondary winding is proportional to the magnetic flux surrounding the secondary winding, the output voltage of the transformer is generally equal to the input voltage times the ratio of the number of turns in the secondary winding over the number of turns in the primary winding. Thus, by changing the ratio of secondary turns to primary turns, the ratio of output to input voltage can be changed, thereby controlling or regulating the output voltage of the transformer. This ratio can be changed by effectively changing the number of turns in the primary winding and/or the number of turns in the secondary winding. This is accomplished by making connections between different connection points or "taps" within the winding(s). A device that can make such selective connections to the taps is referred to as a "tap changer".

Generally, there are two types of tap changers: on-load tap changers and de-energized or "off-load" tap changers. An off-load tap changer uses a circuit breaker to isolate a transformer from a voltage source and then switches from one tap to another. An on-load tap changer (or simply "load tap changer") switches the connection between taps while the transformer is connected to the voltage source. A load tap changer may include, for each phase winding, a selector switch assembly, a bypass switch module and a vacuum interrupter module. The selector switch assembly makes connections between taps, while the bypass switch module connects the tap(s) to a main power circuit. During tap changes, the vacuum interrupter module safely carries the current between the tap(s) and the main power circuit. A drive system moves the selector switch assembly, the bypass switch module and the vacuum interrupter module. The operation of the selector switch assembly, the bypass switch module and the vacuum interrupter module are interdependent and carefully choreographed. As such, these assemblies and, load tap changers in general, are conventionally complex devices that are difficult to manufacture and must be carefully maintained. Moreover, conventional tap changers are based on old configurations that are heavily dependent on mechanical interconnections.

Thus, there is a need to provide an improved selector switch assembly for a load tap changer that has a robust configuration, is less expensive, and easier to manufacture than conventional configurations.

SUMMARY OF THE INVENTION

An objective of the present invention is to fulfill the need referred to above. In accordance with the principles of the invention, this objective is obtained by providing a selector switch assembly for a load tap changer. The selector switch assembly includes a bevel gear structure coupled with a motor drive shaft, a shaft assembly coupled with the bevel gear structure so that the bevel gear structure causing rotation of the shaft assembly, and a switch for each phase. Each switch includes a helical gear fixed to the shaft assembly for rotation therewith, a pinion gear engaged with the helical gear so as to cause rotation of the pinion gear, the pinion gear having a first follower coupled to one side thereof and a second follower coupled to an opposing side thereof, the pinion gear having a hub, a first Geneva gear wheel mounted on a first shaft and associated with the first follower, a second Geneva gear wheel mounted on a second shaft that is concentric with the first shaft and associated with the second follower, each of the first and second Geneva gear wheels having a plurality of spaced slots in a periphery thereof such that when the pinion gear rotates and the associated follower engages a slot, the associated Geneva gear wheel rotates an intermittent indexed amount. A first contact arm is associated with the first Geneva gear wheel so as to rotate therewith, and a second contact arm associated with the second Geneva gear wheel so as to rotate therewith. Each of the first and second contact arms carries contacts constructed and arranged so that upon rotation of the contact arm, the contacts engage fixed contacts which define tap positions of the load tap changer. Each switch includes lock out provisions whereby a tap change is prevented outside of defined boundaries and outside of the proper sequence.

In accordance with another aspect of the invention, a driven wheel of a Geneva gear system includes a body having surfaces defining a central opening. A plurality of radially extending slots is provided in the body. The slots are evenly spaced about a periphery of the body so as to define a plurality of first locking surfaces between pairs of the slots at the periphery of the body with each first locking surface being defined by an arc having a certain length. A plate member is associated with the body. The plate member includes a plurality of arc-shaped cutouts in a periphery thereof, with each cutout being adjacent to an associated first locking surface and having an arc curvature substantially equal to a curvature of the arc defining the adjacent first locking surface. Each arc-shaped cutout has an arc length greater than the certain length, thereby defining an extended locking surface.

Other objectives, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF AN EXAMPLE EMBODIMENT

Figure 1:
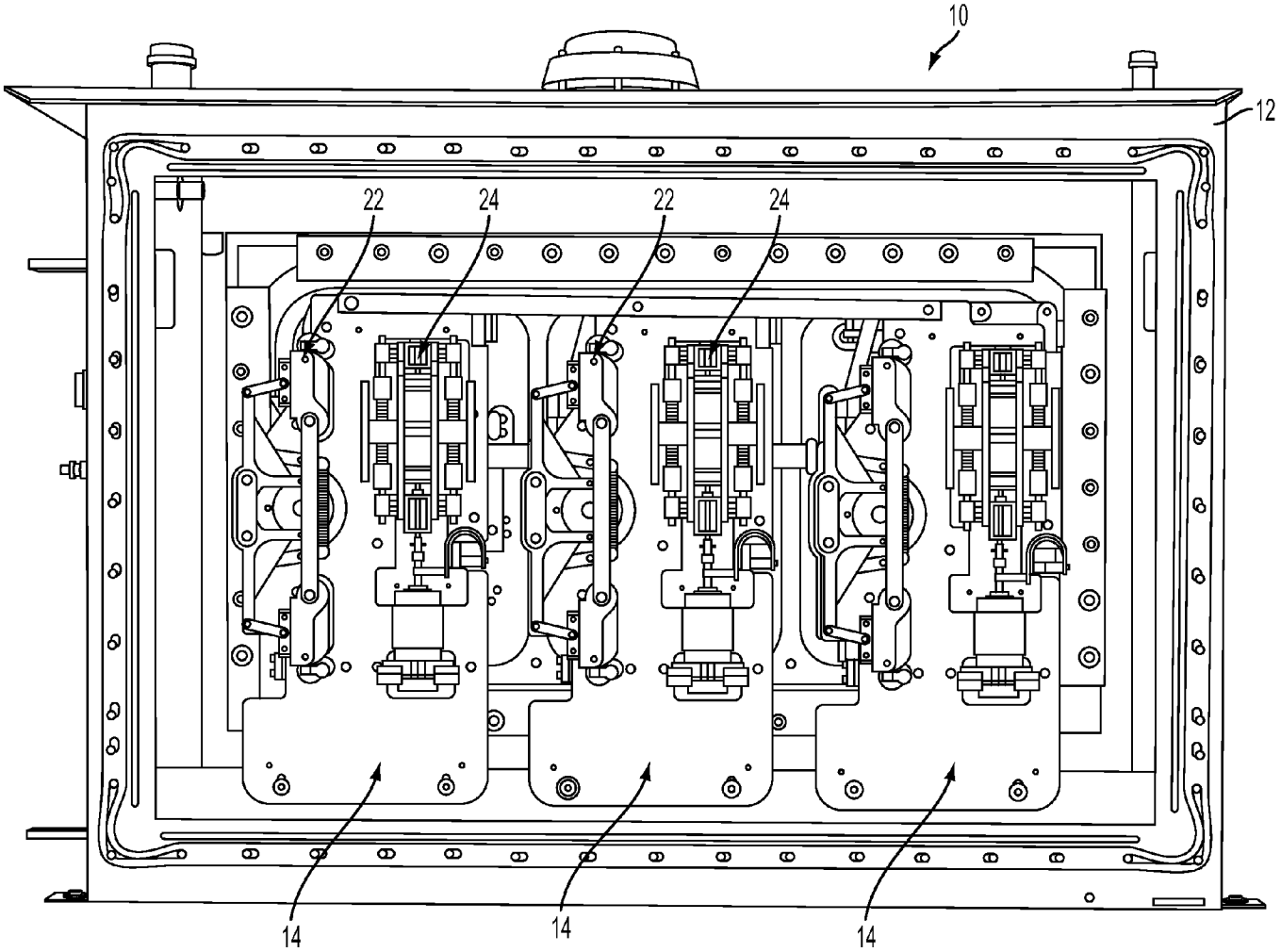
FIG. 1 is a front view of a load tap changing assembly shown with a cover removed and in accordance with an embodiment of the present invention.
Figure 3:
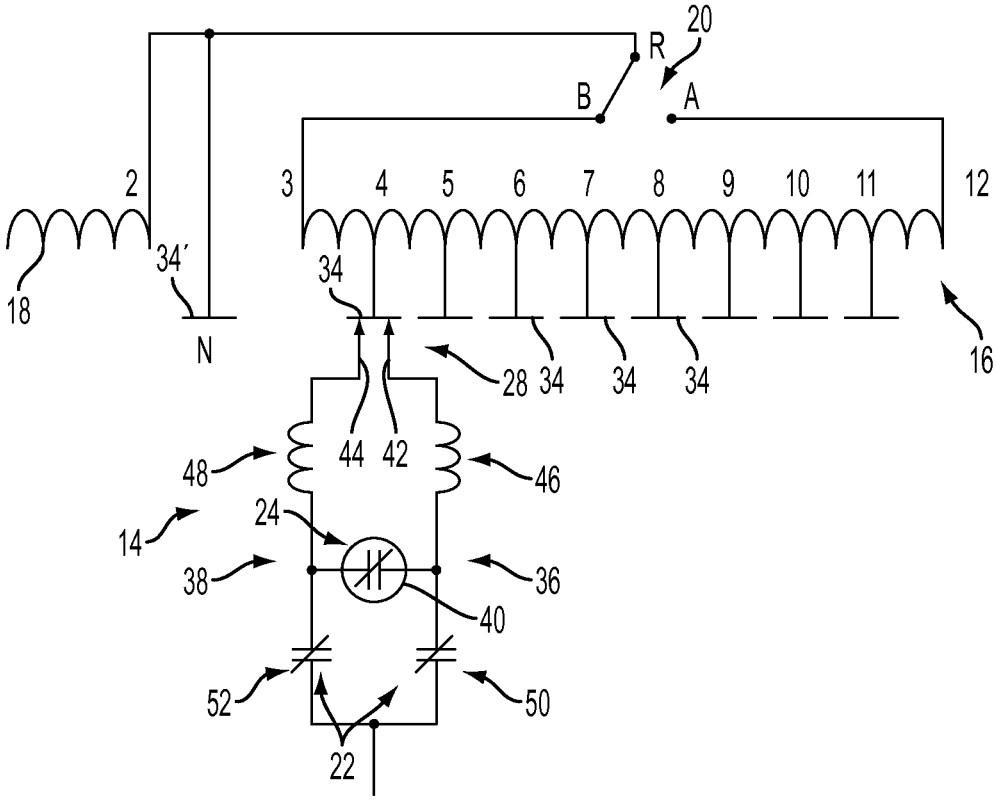
FIG. 3 is a schematic view of a diverter of the tap changing assembly of FIG. 1, shown connected to a regulating winding.

With reference to FIG. 1 a tap changing assembly is shown, generally indicated at 10, in accordance with an embodiment of the invention. The assembly 10 includes a housing 12 (shown with cover removed) that contains three circuits or diverters 14, each of which is operable to change taps on a regulating winding 16 (see FIG. 3) for one phase of a transformer. Each diverter 14 may be utilized in a linear configuration, a plus-minus configuration or a coarse-fine configuration. In the linear configuration, the voltage across the regulating winding 16 is added to the voltage across a main (low voltage) winding 18 (FIG. 3). In the plus-minus configuration, the regulating winding 16 is connected to the main winding 18 by a change-over switch 20, which permits the voltage across the regulating winding 16 to be added or subtracted from the voltage across the main winding 18. In the coarse-fine configuration, there is a coarse regulating winding (not shown) in addition to the (fine) regulating winding 16. A change-over switch (not shown) connects the (fine) regulating winding to the main winding 18 either directly, or in series, with the coarse regulating winding.

Each diverter 14 includes a bypass switch module, generally indicated at 22 and a vacuum interrupter module, generally indicated at 24, the function of which will be explained below.

Figure 2:
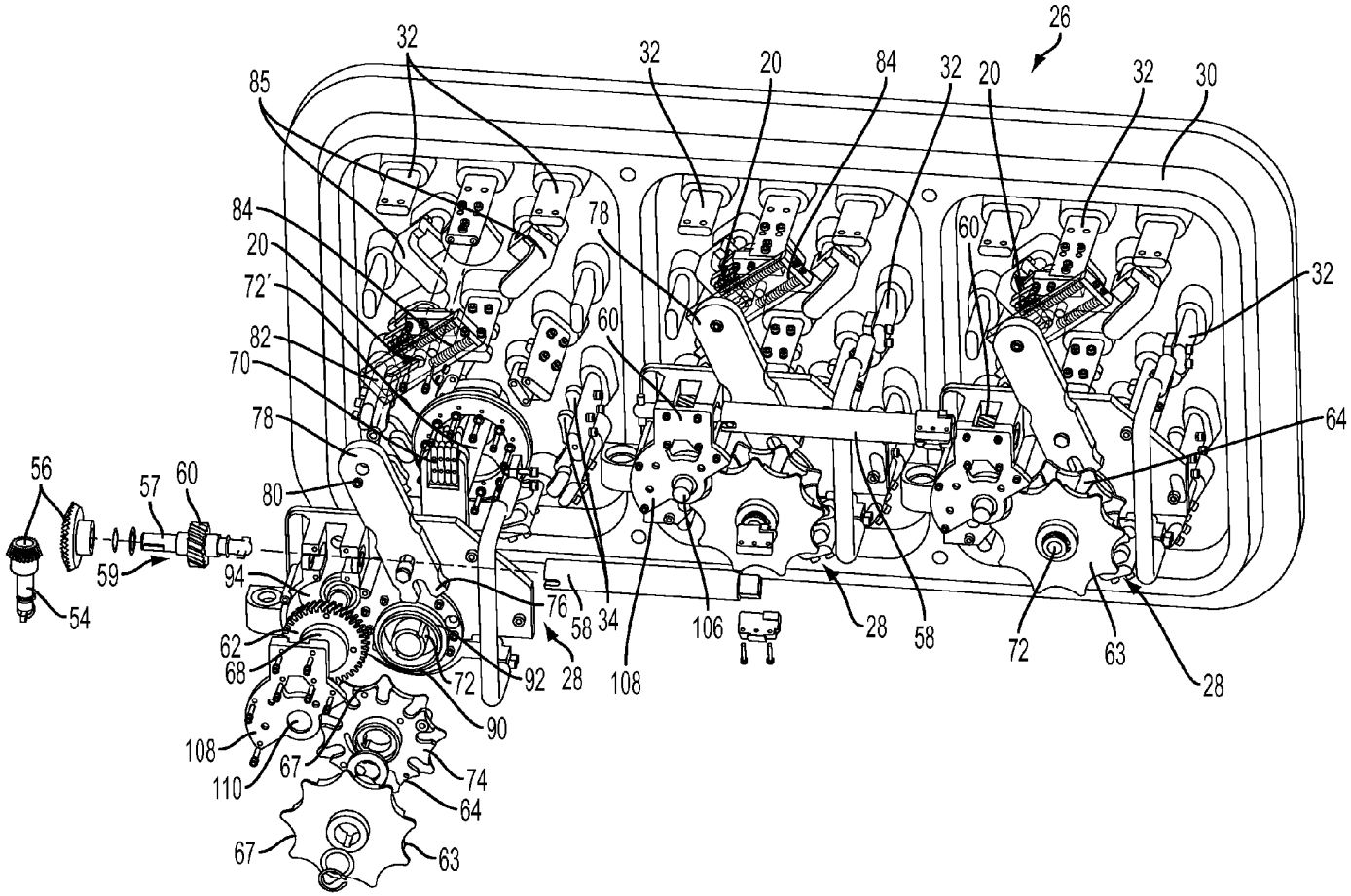
FIG. 2 is a view of a of a selector switch assembly of the load tap changing assembly, with one switch thereof shown in exploded view.

With reference to FIG. 2, a selector switch assembly, generally indicated at 26, is shown in accordance with an embodiment. The assembly 26 includes a switch 28 that is associated with each diverter 14. The left most switch 28 in FIG. 2 is shown in exploded view. Each switch 28 is operatively associated with and disposed under a respective bypass switch module 22 and vacuum interrupter module 24 of each diverter 14. Thus, the selector switches 28 are not seen in FIG. 1. Returning to FIG. 2, a preferably one-piece molded epoxy backboard 30 acts as an insulating bushing between the transformer and the tap changer assembly 12. A plurality of bus bars 32 are molded into the backboard 30 and extend through the backboard 30 so as to connect with leads of the transformer at the rear of and externally of the tap changing assembly 10. Each bus bar 32 also connects with two stationary contacts 34 coupled thereto. The backboard 30, in addition to making the electrical connections to the transformer winding 16, supports the switches 28 and reversing switches 20 and also serves as an oil tight barrier between the tap changer assembly 10 and transformer oil enclosure.

Referring now to FIG. 3, there is shown schematic drawing of one of the electrical diverters 14 of the tap changing assembly 10 connected to the regulating winding 16 in a plus-minus configuration. The electrical circuit 14 is arranged into first and second branch circuits 36, 38 and generally includes the switch 28, the bypass switch module 22 and the vacuum interrupter module 24 comprising a vacuum interrupter 40.

The vacuum interrupter module 24 for each phase protects electric power distribution systems from damage due to short circuits in the tap changer assembly 10. In the embodiment, the vacuum interrupter module 24 includes a vacuum interrupter 40, its mechanical actuators, mechanical dampers and a current sensing transducer. The vacuum interrupter 40 includes two high purity gas-free metal contacts housed in an evacuated cylinder. The contacts are mechanically abutted together, predominately by the force of a spring in an external mechanism, when carrying current between the two interrupter contacts. Thus, the contacts are engaged to carry current while the switch 28 changes taps, as will be explained below. One of the contacts is movable with the other is stationary such that the contacts can be mechanically separated from one another (e.g., by spring force) to break the circuit in which the interrupter is coupled, when tap changing is completed. The switch 28 only moves when the vacuum interrupter contacts are open. The switch does not switch any current. The vacuum interrupter contacts are closed at the end of a tap change.

Each switch 28 comprises movable first and second contact arms 42, 44 and a plurality of the stationary contacts 34 which are connected to the taps (e.g., 3, 4, 5 . . . ) of the winding 16, respectively. The first and second contact arms 42, 44 are connected to reactors 46, 48, respectively, which reduce the amplitude of the circulating current when the switch 28 is bridging two taps. The first contact arm 42 is located in the first branch circuit 36 and the second contact arm 44 is located in the second branch circuit 38. The bypass switch module 22 comprises first and second bypass switches 50, 52, with the first bypass switch 50 being located in the first branch circuit 36 and the second bypass switch 52 being located in the second branch circuit 38. Each of the first and second bypass switches 50, 52 is connected between its associated reactor and the main power circuit. The vacuum interrupter 40 is connected between the first and second branch circuits 36, 38 and comprises a fixed contact and a movable contact as discussed above.

The first and second contact arms 42, 44 of the switch 28 can be positioned in a non-bridging position or a bridging position. In a non-bridging position, the first and second contact arms 42, 44 are connected to a single one of a plurality of taps on the winding 16 of the transformer as in FIG. 3. In a steady state condition, the contacts of the vacuum interrupter 40 are closed and the contacts in each of the first and second bypass switches 50, 52 are closed. The load current flows through the first and second contact arms 42, 44 and the first and second bypass switches 50, 52. No current flows through the vacuum interrupter 40 and there is virtually no circulating current in the reactor circuit.

In a bridging position, the first contact arm 42 is moved and connected to one of the taps (e.g., tap 5) and the second contact 44 is connected to another, adjacent one of the taps (e.g., tap 4). The first bypass switch 50 is first opened, which occurs without substantial arcing since the vacuum interrupter 40 is closed and current is transferred from the first branch circuit 36 to the vacuum interrupter 40. The vacuum interrupter 40 is then opened to isolate the first branch circuit 36. This allows the first contact arm 42 to next be moved to tap 5 without arcing. After this move, the vacuum interrupter 40 is first closed and then the first bypass switch 50 is closed. This completes the tap change. At this point, the first contact arm 42 is connected to tap 5 and the second contact arm 44 remains connected to tap 4, with the first and second contact arms 42, 44 being in a bridging position. In a steady state condition, the contacts of the vacuum interrupter 40 are closed and the contacts in each of the first and second bypass switches 50, 52 are closed. The reactors 46, 48 are now connected in series and the voltage at their midpoint is one half of the voltage per tap selection. Circulating current now flows in the reactor circuit.

In either bridging or non-bridging tap changes, current flows continuously during the tap changes, while the first and second contact arms 42, 44 are moved in the absence of current.

As best shown in FIG. 3, each switch 28 may have eight stationary contacts 34 connected to eight taps on the winding 16 and one stationary contact 34' connected to a neutral tap of the winding 16. Thus, with the change-over switch 20 on the B terminal (as shown), the switch 28 is movable among a neutral position and sixteen discreet raise (plus) positions (e.g., eight non-bridging positions and eight bridging positions). With the change-over switch 20 on the A terminal, the switch 28 is movable among a neutral position and sixteen discreet lower (minus) positions (i.e., eight non-bridging positions and eight bridging positions). Accordingly, each switch 28 is movable among a total of 33 positions (one neutral position, 16 raise (R) positions and 16 lower (L) positions).

Figure 4:
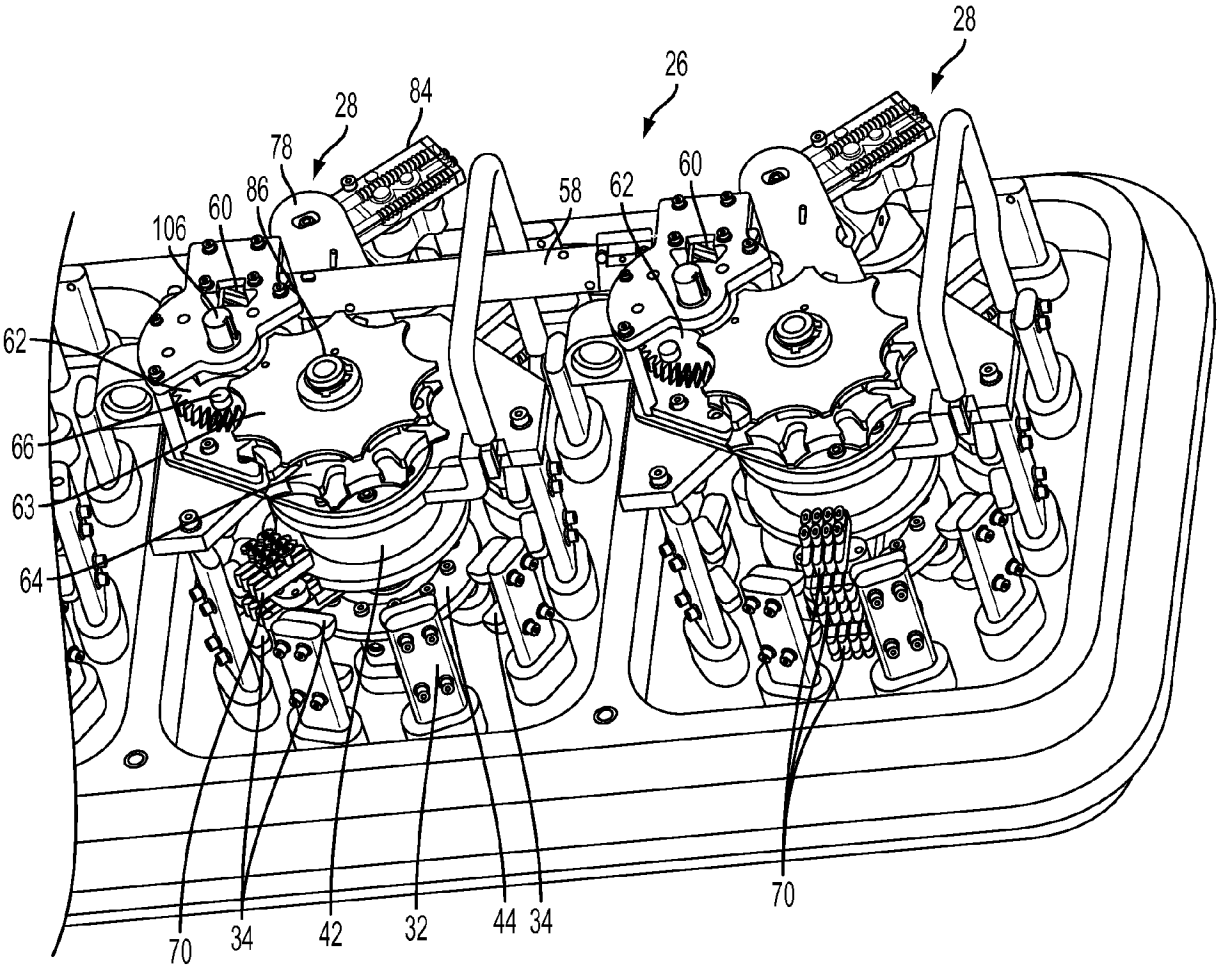
FIG. 4 is a top perspective view of two switches of the selector switch assembly of FIG. 2.

With reference to FIGS. 2 and 4, the selector switch assembly 26 is a three phase switch which is operated via a continuous rotational motion a motor drive shaft 54. This rotary motion is transmitted through a bevel gear structure 56 to a first shaft 57 connected with pilot shafts 58. Bevel gear structure 56 is coupled to a motor drive shaft 54. Shafts 57 and 58 are perpendicular to the motor drive shaft 54 and shaft 57 can be considered to be part of shaft assembly, generally indicated at 59. The pilot shaft 58 is made up of segmented fiber wound shafts which are used to insulate between the phases. Each switch 28 has a helical gear 60 fixed to the shaft assembly 59 and engaged with a pinion gear 62, which functions as the Geneva driver for first and second driven Geneva gear wheels 63, 64, respectively. The pinion gear 62 continuously rotates and has a cam follower 66 (FIG. 4) on each opposing side of the pinion gear. Upon rotation of the pinion gear 62, the follower 66 is received in slots 65 (e.g., nine slots in the embodiment of FIG. 5) in the Geneva gear wheel 63. A substantially cylindrical hub 68 of the pinion gear 62 mates with arc-shaped locking surfaces 67 of the Geneva gear wheel 63 to lock out the motion of the wheel 63 until the cam follower 66 of the pinion gear 62 engages a slot 65. The follower 66 will then rotate the Geneva gear wheel 63 and thus the first contact arm 42 around to its next tap position and lock out any further movement that is not requested. The hub 68 of the pinion gear 62 is not a continuous cylinder. This allows the Geneva gear system to be "unlocked" only for the period of time that movement is expected due to the cam follower 66 engaging a slot 65. This interaction creates intermittent indexing motion of the Geneva gear wheel 63 from the continuous motion of the pinion gear 62. For the next sequential tap change operation, the follower 66 (not shown) on the opposite side of the pinion gear 62 will engage the second Geneva gear wheel 64 and create the same motion as described above to move the second contact arm 44.

Figure 7:
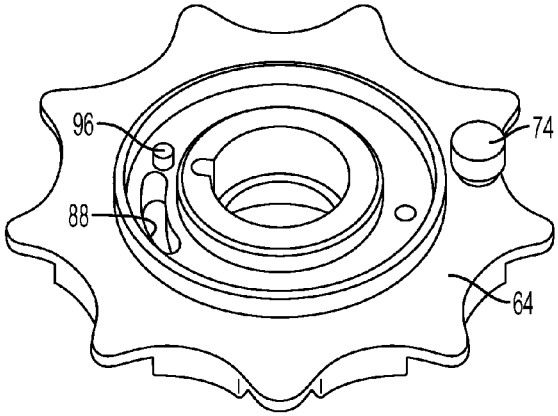
FIG. 7 is a second side of the second Geneva gear wheel of FIG. 6.
Figure 8:
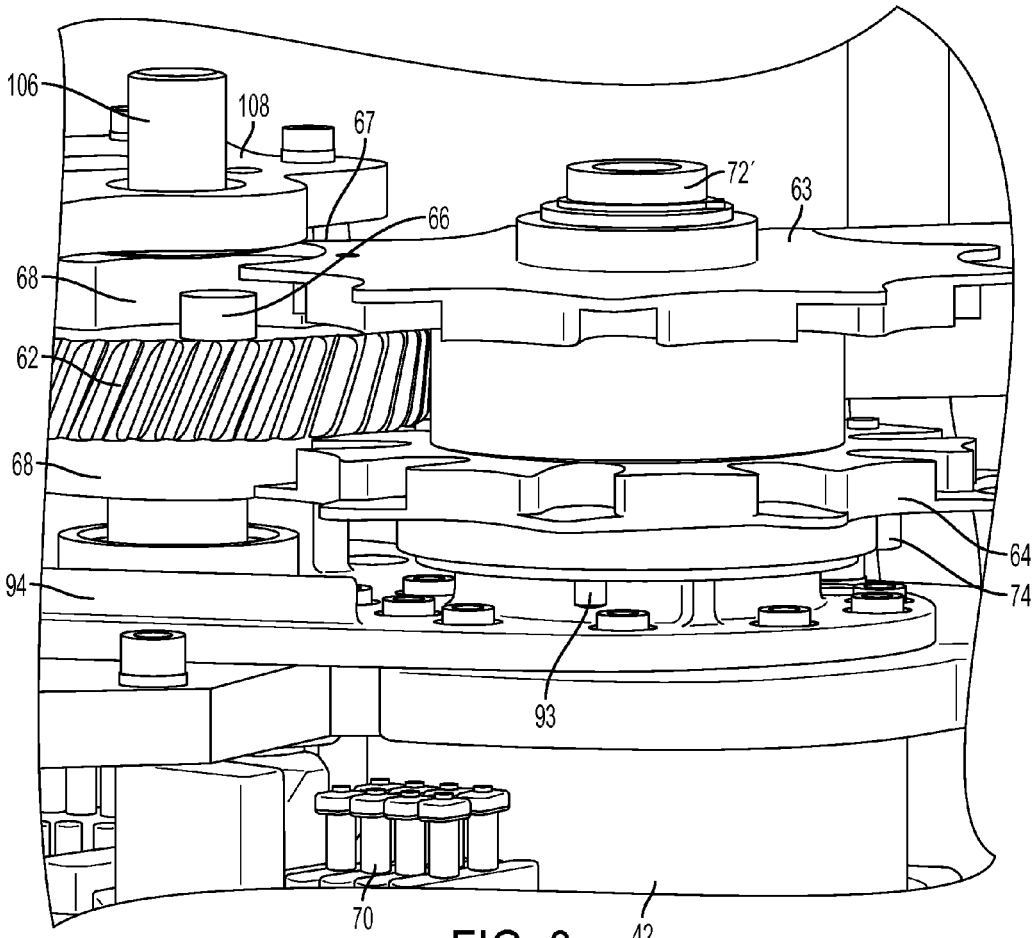
FIG. 8 is an enlarged side view of the first and second Geneva gear wheels cooperating with a pinion gear of a switch.
Figure 9:
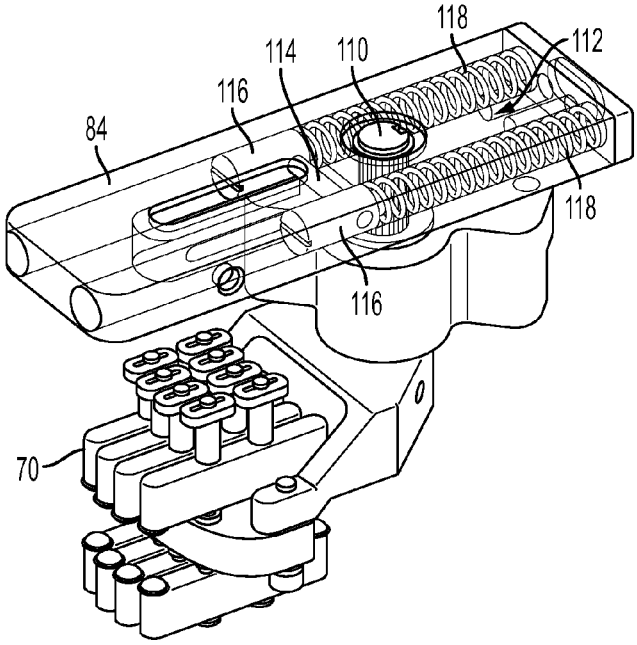
FIG. 9 is a perspective view of reversing switch components of a switch of FIG. 2.
Figure 10:
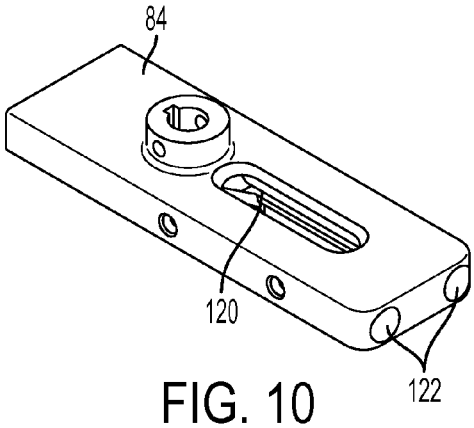
FIG. 10 is a top view of a crank arm of the reversing switch of FIG. 9.
Figure 11:
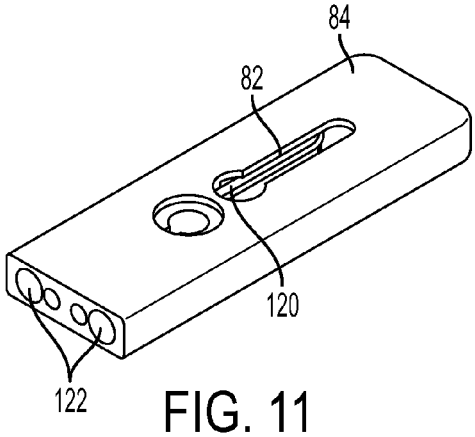
FIG. 11 is a bottom view of the crank arm of FIG. 10.

The Geneva gear wheels 63, 64 are rigidly linked to moving contacts 70 of the first and second contact arms 42, 44 via concentric, insulated selector shafts 72, 72', respectively. Upon completion of a tap change, the moving contacts 70 engage with certain of the stationary contacts 34. The second Geneva gear wheel 64 has a cam follower 74 (FIGS. 7 and 8) that creates a reversing switch operation that occurs one time in all 33 sequential (all raise or all lower) positions. The cam follower 74 of the second Geneva gear wheel 64 (only while this wheel is operating between position 1L and R) will engage a slot 76 in an insulated sector plate 78, to rotate the sector plate 78. The sector plate 78 also has a cam follower 80 that operates in a slot 82 inside of a crank arm 84. The rotary motion of the sector plate 78 about a shoulder bolt will in turn cause the crank arm 84 to rotate. With reference to FIG. 9, the crank arm 84 is rigidly connected to a reversing shaft 110, and the shaft 110 is rigidly connected to the moving contacts of the reversing switch 20 that engage fixed terminals 85 to reverse the polarity of the tapped windings such that the tap turns are either added to the main winding or removed from the main winding turns. The sector plate 78 rotates per a defined arc and creates the reversing switch movement.

It was determined that a force is needed to prevent other forces in the system from moving the contacts 70 off of position. In addition to this required force, the necessary force was calculated that is required to cause the moving contacts 70 to complete the movement of the switch once the sector plate 78 (or crank arm 84) has traveled "over center". Thus, the configuration of the spring structure, generally indicated at 112 in FIG. 9, was based on the above force calculations. The method used for connecting the spring force to the cam follower 80 is via a dowel pin 114 which is pressed into two guide rods 116. Each guide rod 116 is connected to a compression spring 118. Springs 118 define the spring structure 112. A dowel pin slot 120 is machined into a side of the cam slot 82 in the crank arm 84 to allow for the movement of the dowel pin 114. Two parallel bores 122 are machined into the crank arm 84. The springs 118 and guide rods 116 are loaded into the bores 112. As the reversing switch moves, the springs 118 are compressed from the cam follower 80 pushing the dowel pin 114 and guide rods 116 toward the pivot of the crank arm 84. After the sector plate/crank arm has traveled "over center" the spring force is sufficient to ensure that the moving contacts 70 will all be in the proper position.

Figure 5:
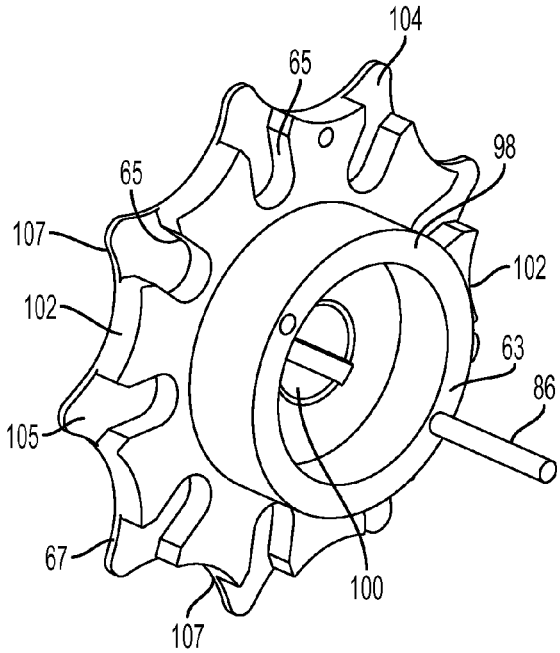
FIG. 5 is a first Geneva gear wheel of a switch of FIG. 2.
Figure 6:
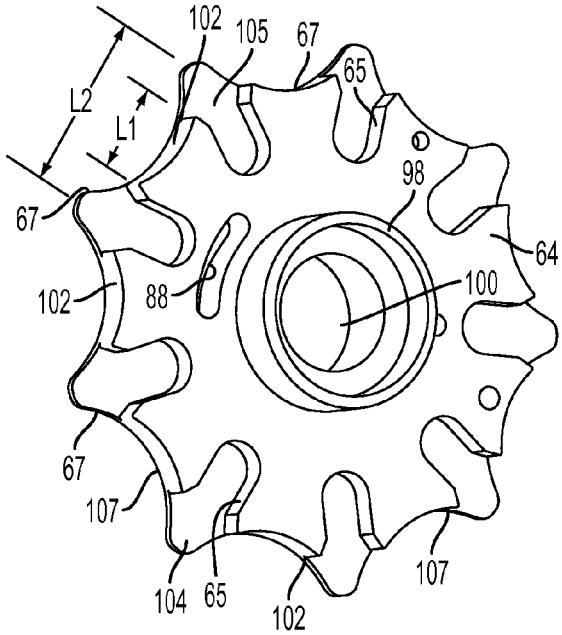
FIG. 6 is a first side of a second Geneva gear wheel of a switch of FIG. 2.

There is a lock out provision in each switch 28 whereby a tap change is prevented outside of defined boundaries, which are positions 16L-16R. A tap change outside of the proper sequence will also be prevented. As best shown in FIGS. 5 and 6, there is a pin 86 pressed into the first Geneva gear wheel 63 that operates within a defined slot 88 in the second Geneva gear wheel 64. This interaction will only allow tap change operations in the proper sequence (e.g., the second Geneva gear wheel 64 will not be allowed to move two sequential operations in the same direction). The same pin 86 extends through the second Geneva gear wheel 64 and into a groove 90 in a lock ring 92 (FIG. 2). The lock ring 92 also has a pin 93 (FIG. 8) pressed into it on the bottom side thereof. In one direction (raise or lower) during operation, the pin 86 extending through the second Geneva gear wheel 64 will engage the groove 90 in the lock ring 92 and the lock ring 92 will begin to rotate. In the end position (16L or 16R) the pin 93 of the lock ring 90 will engage a hard stop built into the main hub 94 and prevent any additional tap changes in this direction. Since the selector switch assembly 26 has an odd number (33) of positions, the same pin 93 cannot be used to lock movement in both directions. Therefore, there is an additional pin 96 (FIG. 7) pressed into the second Geneva gear wheel 64 that will lock out motion (still using the lock ring 92 but with the additional pin 96) in the direction opposite of the motion locked by the pin 93. This provides a selector switch assembly 26 with a much more robust configuration that is less expensive and easier to manufacture than conventional configurations.

As noted above, the Geneva gear system comprising the pinion gear 62 and the associated Geneva gear wheels 63, 64 is used to change a rotary motion into intermittent indexed rotary motion. In accordance with an embodiment, the Geneva gear wheels 63 and 64 have improved locking surfaces 67. With reference to FIGS. 5 and 6, each driven Geneva gear wheel 63, 64 includes a body 98 having surfaces defining a central opening 100 there-through for receiving the associated shaft 72, 72'. A plurality of the radially extending slots 65 is provided in the body 98 that engage the associated follower 66 of the pinion gear 62 as explained above. The slots 65 are evenly spaced about a periphery of the body 98 so as to define a plurality of first locking surfaces 102 between a pair of slots 65 at the periphery of the body 98. Each first locking surface 102 is defined by an arc of a certain length L1. If the locking dwell of the Geneva gear system is not sufficient, the driven gear wheel 63, 64 can release from the locked position with the hub 68 and continue in motion out of sequence. In accordance with an embodiment, a sufficient locking surface is ensured by providing a plate member 104 associated with (preferably integral with) the body 98. The plate member 104 includes a plurality of arc-shaped cutouts 107 in a periphery thereof, with each cutout 107 being adjacent to an associated first locking surface 102 and having an arc curvature substantially equal to a curvature of the arc defining the adjacent locking surface 102. A portion 105 of the plate member 104 is disposed over each slot 65 so as to close an axially extending end of each slot 65. Each arc-shaped cutout 107 has an arc length L2 greater than the certain length L1 so as to define the extended locking surface 67. A thickness of each first locking surface 102 is greater than a thickness of each extended locking surface 67. Thus, the extended locking surfaces 67 extend beyond where the slot 65 breaks the standard, first locking surface 102 to allow a follower 66 to engage the driven gear wheel 63 or 64. As shown in FIG. 8, the plate member 104 is located outside (above or below) the geometry of the followers 66. Thus, by providing the extended locking surfaces 67, more cam dwell is provided during a tap change cycle which adds additional precision to the tap change movement. Furthermore, the extended locking surfaces 67 preventing drift from the desired position during long periods of non-indexed use.

Returning to FIGS. 2 and 4, the shaft 106 of the pinion gear 62 extends through a hole 110 in plate 108 that is mounted to the main hub 94. The hole 110 has a ball bearing pressed into it which functions as a guide for the pinion shaft 106. The by-pass switch module 22 and vacuum interrupter module 24 are driven by a by-pass shaft (not shown). The by-pass shaft is rigidly connected to the pinion shaft 106. Since the by-pass shaft and pinion shaft 106 are at a different electrical potential, there is an insulating member (another fiber wound shaft like the pilot shaft) that operates between them.

Although the embodiment shows a three-phase, thirty-three position load tap changer, the selector switch assembly can be employed in a single phase and reduced position load tap changer.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A selector switch assembly for load tap changer of a transformer having a plurality of phase windings, the assembly comprising:

a bevel gear structure coupled with a motor drive shaft, a shaft assembly coupled with the bevel gear structure so that the bevel gear structure causes rotation of the shaft assembly, and a switch for each of the phase windings, each switch comprising:

a helical gear fixed to the shaft assembly for rotation therewith, a pinion gear directly engaged with the helical gear so as to cause rotation of the pinion gear, the pinion gear having a first follower coupled to one side thereof and a second follower coupled to an opposing side thereof, the pinion gear having a hub, a first Geneva gear wheel mounted on a first shaft and associated with the first follower, a second Geneva gear wheel mounted on a second shaft that is concentric with the first shaft and associated with the second of the follower, each of the first and second Geneva gear wheels having a plurality of spaced slots in a periphery thereof such that when the pinion gear rotates and the associated follower engages a slot, the associated Geneva gear wheel rotates an intermittent indexed amount, a first contact arm associated with the first Geneva gear wheel so as to rotate therewith, and a second contact arm associated with the second Geneva gear wheel so as to rotate therewith, each of the first and second contact arms having contacts constructed and arranged so that upon rotation of the contact arm, the contacts engage fixed contacts which define tap positions of the load tap changer.

2. The assembly of claim 1, wherein the fixed contact are disposed on bus bars constructed and arranged to be connected with leads of a transformer.

3. The assembly of claim 1, wherein the second Geneva gear wheel includes an integral cam follower that, under certain conditions, is constructed and arranged to cause motion of contacts of a reversing switch to reverse polarity of tapped windings.

4. The assembly of claim 3, further comprising a sector plate having a slot, the cam follower being constructed and arranged to engage the sector plate slot to cause rotation thereof, the sector plate being constructed and arranged to rotate a crank arm associated with the contacts of the reversing switch so that the contacts of the reversing switch engage fixed terminals.

5. The assembly of claim 4, wherein the crank arm includes spring structure associated with the cam follower, wherein after the crank arm has traveled "over center", the spring structure is constructed and arranged to ensure that the contacts are in a required position.

6. The assembly of claim 1, wherein the first Geneva gear wheel includes a pin integral therewith that is constructed and arranged to extend through and move with a slot defined in the second Geneva gear wheel so as to only allow tap change operations in a proper sequence.

7. The assembly of claim 6, wherein the pin extends into a groove in a lock ring to rotate the lock ring, the lock ring including a second pin constructed and arranged so that in a certain rotational direction, the second pin will engage a hard stop to prevent any additional tap changes in the certain rotational direction.

8. The assembly of claim 7, further comprising a third pin coupled to the second Geneva gear wheel and constructed and arranged to cause the lock ring to prevent additional tap changes in a direction opposite the certain direction.

9. The assembly of claim 1, wherein there are three phases and each switch is movable among thirty-three positions.

10. The assembly of claim 9, wherein the shaft assembly includes segmented fiber wound shafts between the selector switches of first and second phases and between the selector switches of second and third phases.

11. The assembly of claim 1, wherein the shaft assembly is generally perpendicular to the motor drive shaft.

12. The assembly of claim 1, wherein each of the first and second Geneva gear wheels includes extended locking surfaces at a periphery thereof, a portion of the hub being constructed and arranged to engage the extended locking surfaces to prevent motion of the Geneva gear wheel until the associated cam follower of the pinion gear engages a slot.

13. The assembly of claim 12, wherein each of the first and second Geneva gear wheels comprises:

a body having surfaces defining a central opening receiving the associated first or second shaft, a plurality of first locking surfaces between pairs of the slots in the Geneva gear wheel, each first locking surface being defined by an arc having a certain length, and a plate member associated with the body, the plate member including a plurality of arc-shaped cutouts in a periphery thereof, with each cutout being adjacent to an associated first locking surface and having an arc curvature substantially equal to a curvature of the arc defining the adjacent first locking surface, each arc-shaped cutout having an arc length greater than the certain length, thereby defining the extended locking surface.

14. The assembly of claim 13, wherein the plate member is integral with the body.

15. The assembly of claim 13, wherein a portion of the plate member is disposed over each slot so as to close an axially extending end of each slot.

16. The assembly of claim 13, wherein a thickness of each first locking surface is greater than a thickness of each extended locking surface.

17. A driven wheel of a Geneva gear system, the driven wheel comprising:

a body having surfaces defining a central opening, a plurality of radially extending slots in the body, the slots being evenly spaced about a periphery of the body so as to define a plurality of first locking surfaces between pairs of the slots at the periphery of the body, each first locking surface being defined by an arc having a certain length, and a plate member coupled with the body, the plate member including a plurality of arc-shaped cutouts in a periphery thereof, with each cutout being adjacent to an associated first locking surface and having an arc curvature substantially equal to a curvature of the arc defining the adjacent first locking surface, each arc-shaped cutout having an arc length greater than the certain length, thereby defining an extended locking surface.

18. The wheel of claim 17, wherein the plate member is integral with the body.

19. The wheel of claim 18, wherein a portion of the plate member is disposed over each slot so as to close an axially extending end of each slot.

20. The wheel of claim 17, wherein a thickness of each locking surface is greater than a thickness of each extended locking surface.

21. The wheel of claim 17, in combination with a pinion gear, the pinion gear having a follower and a hub, a portion of the hub being constructed and arranged to engage an ended locking surface to prevent motion of the Geneva gear wheel until the follower of the pinion gear engages a slot.

* * * * *